United States Patent [19]

Daffer, Jr.

[11] 4,083,561

[45] Apr. 11, 1978

[54] SOCCER PRACTICE NET

[75] Inventor: Fred R. Daffer, Jr., 17212 Berlin La., Huntington Beach, Calif. 92649

[73] Assignee: Fred R. Daffer, Jr., Huntington Beach, Calif.

[21] Appl. No.: 713,462

[22] Filed: Aug. 11, 1976

[51] Int. Cl.[2] ..... A63B 71/02

[52] U.S. Cl. ..... 273/103; 273/105 R; 273/127 C

[58] Field of Search ..... 40/125 G, 125 H; 273/1 B, 29 B, 29 BB, 29 R, 95 R, 95 D, 95 H, 102 R, 102 S, 103, 105 R, 122 R, 127 R, 127 C, 127 B, 181 R, 181 F, 181 K, 30, 26 A, 96 R, 1 R, 29 A, 1, 29, 95, 102, 105, 122, 127, 181

[56] References Cited

U.S. PATENT DOCUMENTS

| | | | |
|---|---|---|---|
| 849,941 | 4/1907 | Titus | 273/26 A |
| 1,540,670 | 6/1925 | Vidmer | 273/181 F |
| 1,566,945 | 12/1925 | Winkley | 273/181 F |
| 1,629,907 | 5/1927 | Dwyer | 273/103 X |
| 2,072,682 | 3/1937 | Morgan | 273/96 R |
| 2,077,343 | 4/1937 | Oakes | 273/127 B |
| 2,161,463 | 6/1939 | Frost | 273/30 |
| 2,827,295 | 3/1958 | Austin | 273/26 A |
| 3,001,795 | 9/1961 | Johnson | 273/181F |
| 3,195,898 | 7/1965 | Respini | 273/181 F |
| 3,501,150 | 3/1970 | Frischman | 273/127 R |
| 3,711,092 | 1/1973 | Hogue | 273/26 A |
| 3,822,883 | 7/1974 | De Vos | 273/95 H |

FOREIGN PATENT DOCUMENTS

| | | | |
|---|---|---|---|
| 945,760 | 1/1964 | United Kingdom | 273/127 R |
| 194,207 | 3/1923 | United Kingdom | 273/29 BB |

*Primary Examiner*—Richard C. Pinkham
*Assistant Examiner*—Vance Y. Hum
*Attorney, Agent, or Firm*—Knobbe, Martens, Olson, Hubbard & Bear

[57] ABSTRACT

A soccer practice net and goal structure is disclosed which is particularly useful in the training of players for the game of soccer. This soccer practice net can be used as a goal structure for games between teams on a large playing area or readily converted to a ball-returning practice net for use in a limited playing area such as a residential backyard by one or more players.

11 Claims, 4 Drawing Figures

FIG. 1.
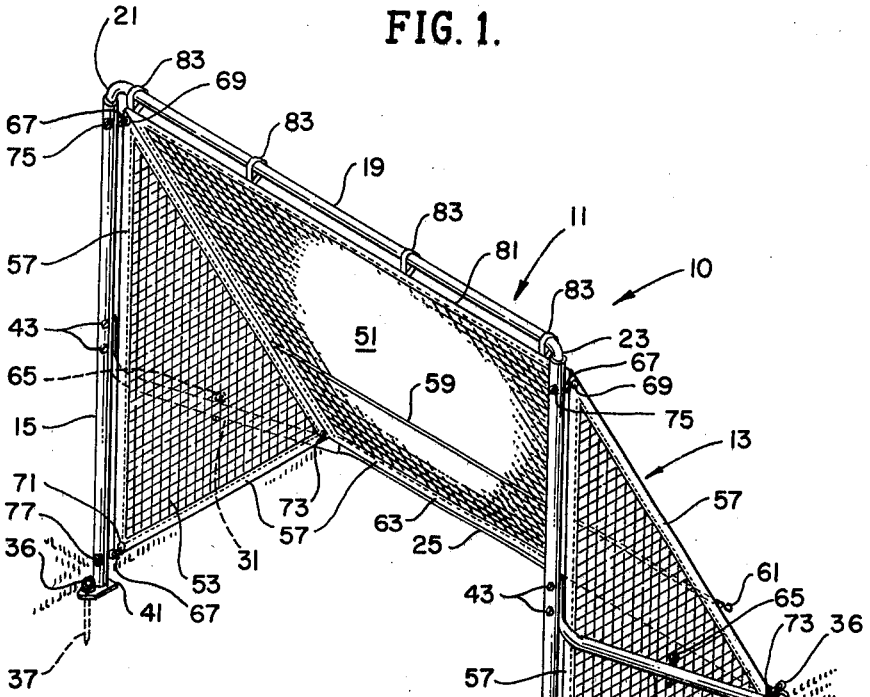
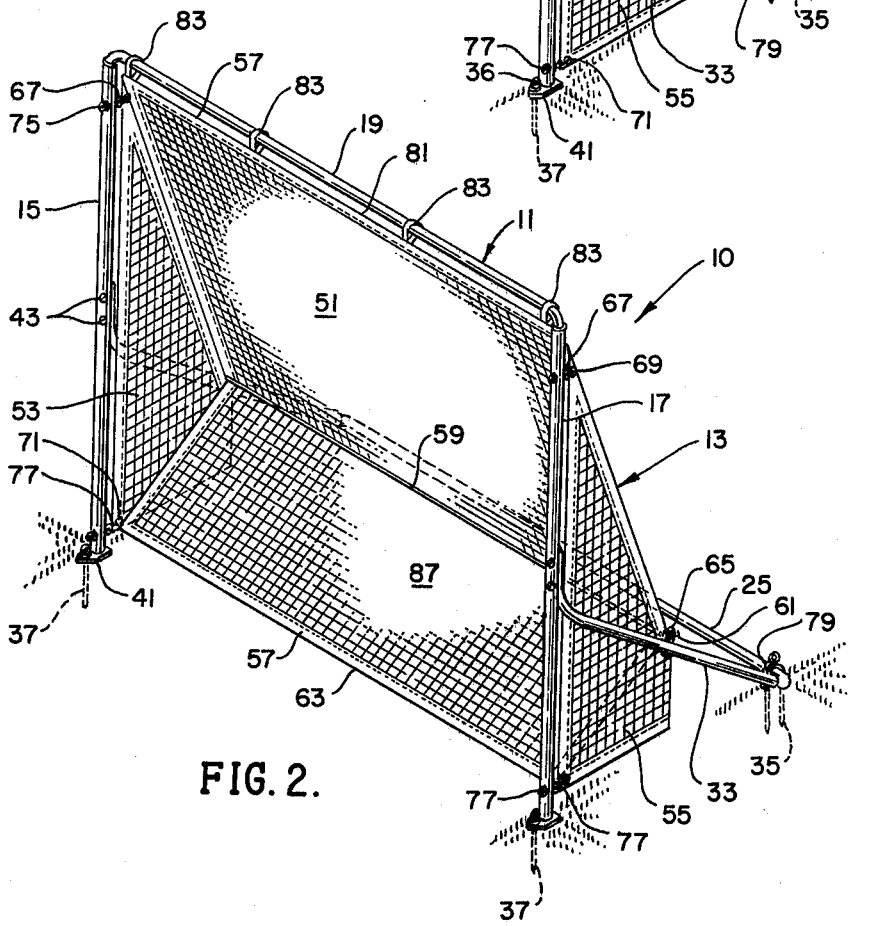
FIG. 2.

FIG. 3.
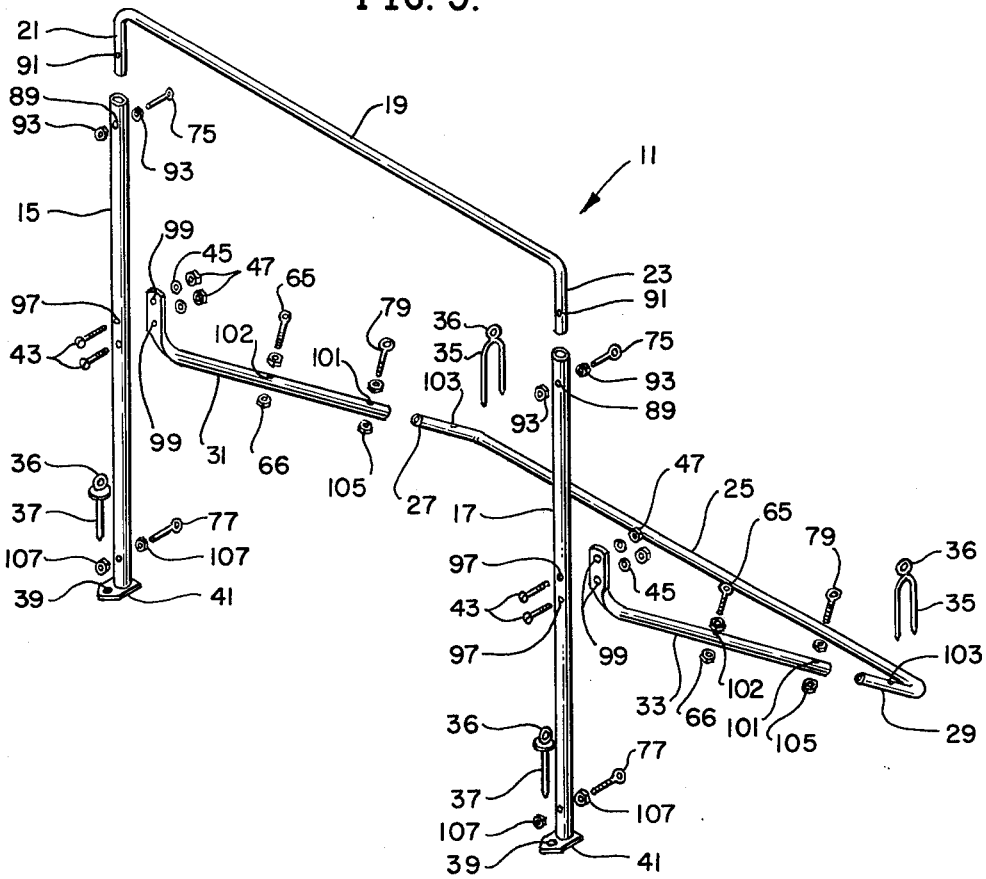
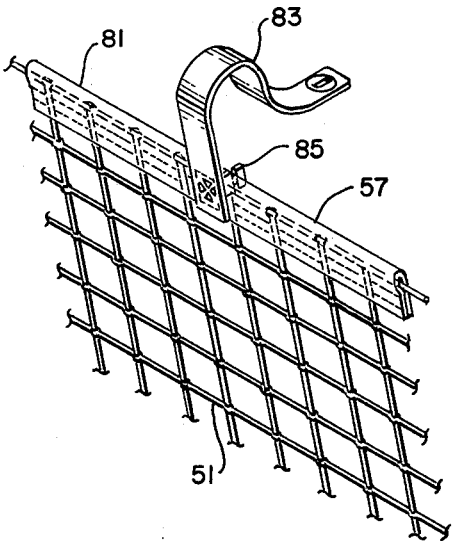
FIG. 4.

SOCCER PRACTICE NET

BACKGROUND AND SUMMARY OF THE INVENTION

The present invention relates to a soccer practice net and/or goal structure which can be easily transported and assembled for use on the playing field. Its normal configuration as a soccer goal net can be quickly converted to a ball-returning practice net by merely shifting the attachment means of the lower edge of the net.

Recent patents for goal structures describe fixed structures which cannot be readily dismantled, transported, or stored when not in use, and do not possess the inherent capability to return the ball to a single player such as the preferred embodiment of the invention to be described herein.

Accordingly, it is the object of the present invention to provide an improved soccer net and goal structure which has the advantages of structural simplicity facilitating easy assembly, a minimum number of component parts facilitating compact packaging for merchandising and transportation, and an inherent capability for quick conversion to a ball-returning practice net without the attachment of additional parts or use of any tools for said conversion.

The preferred embodiment of the invention described herein comprises a net support frame made of tubular material, such as steel, aluminum, or plastic, which can be easily and quickly assembled into its functional configuration, and a backdrop of nylon netting which can be attached to said frame with a minimum number of fasteners requiring no implements for such attachment.

When said invention is used as a soccer goal net for normal game playing, the backdrop netting is attached to the periphery and extremities of the frame by means of simple S-hooks and straps. For conversion of said goal structure to a ball-returning practice net, the lower rear edge of the netting is unhooked and fastened to the forward frame uprights. The ends of a nylon tension cord interwoven through the back panel of the netting are hooked to the angular brace members of the basic frame thus forming a forwardly sloping runway for returning the soccer ball to the player.

These and other advantages of the present invention are best understood through a reference to the drawings, in which:

FIG. 1 is a perspective view of the fully erected goal net showing its configuration for normal use as a goal;

FIG. 2 is a perspective view of the fully erected goal net showing its configuration when converted to a ball-returning practice net;

FIG. 3 is a perspective view of the basic tubular frame and supplementary fasteners showing all of the parts in an exploded position; and FIG. 4 is a partial perspective view showing the details of a typical strap fastener attached to the upper edge of the netting.

DETAILED DESCRIPTION OF THE PREFERRED EMBODIMENT

Referring initially to FIG. 1, a soccer goal net 10 is shown in its fully assembled state as would be erected for use as a goal in a normal soccer game. It comprises an inverted U-frame 11 made of aluminum, steel, or plastic tubing and a backdrop net 13 made of nylon or polypropylene strands having a square or diamond weave. The frame 11 comprises two main upright members 15, 17; a tubular crossbar member 19 having downwardly extending legs 21, 23 which telescope into uprights 15, 17; a rear crossbar member 25 having upwardly extending legs 27, 29 telescoping into angular brace members 31 and 33. The frame 11 is anchored to the ground by means of U-shaped clevises 35 straddling the rear crossbar member 25 at both corners and anchor stakes 37 driven through apertures 39 of foot pads 41 welded to the lower ends of the uprights 15 and 17 (as best shown in FIG. 3). Eyelets 36 are welded to clevises 35 and anchor stakes 37 to facilitate their removal. The angular brace members 31 and 33 are attached to the uprights 15, 17 by means of round head screws 43, lockwashers 45, and nuts 47, as best shown in FIG. 3.

The net 13 comprises a backwardly sloping panel 51 and two triangular shaped side panels 53 and 55. The exterior edges of the nylon net panels are reinforced with binding tape 57, folded over and double-stitched or cemented, as best shown in FIG. 4. A nylon tension cord 59 having S-hooks 61 attached to each end thereof is woven laterally through the netting of back panel 51 approximately one-third the distance from the bottom edge 63. The length of the cord 59 is equal to the width of the back panel 51 permitting S-hooks 61 to be hooked to eyebolts 65 attached at the midpoint of angular braces 31, 33 and maintain the cord 59 under tension. The net 13 is secured to frame 11 at each corner of the triangular side panels 53, 55 by means of S-hooks 67 hooked into grommeted holes 69, 71, 73 and eyebolts 75, 77 and 79 attached to frame 11. The top edge 81 of back panel 51 is attached to the crossbar 19 of frame 11 by a plurality of straps 83 having suitable connector means, such as a twist clip 85 (as best shown in FIG. 4), self-adhesive material sold under the Trademark "Velcro", or other.

FIG. 2 shows the soccer goal net 10 converted into a ball-returning practice net. To achieve this configuration, the bottom edge 63 of the back panel 51 as detached from the eyebolts 79 located at the rear end of the angular braces 31 and 33, brought forward and attached to eyebolts 77 located at the lower ends of uprights 15, 17. The ends of the interwoven cord 59 are hooked to eyebolts 65 on braces 31, 33 on opposite sides of frame 11 to maintain the cord 59 under tension thus forming a forwardly sloping runway 87. The back panel 51 is drawn taut with the upper section sloping rearwardly and the lower section sloping forwardly thus deflecting any soccer ball entering this area in the opposite direction and returning said ball to the player. The taut net provides some resilience for aiding in returning the ball.

Referring now specifically to FIG. 3, the basic frame 11 is shown in a disassembled state. As clearly shown in this figure, the uprights 15, 17; the crossbars 19, 25; and the braces 31, 33 are identical and thus can be manufactured in standardized pairs. When assembling the frame unit 11, the upper crossbar 19 with its leg extensions 21, 23 are telescoped into uprights 15 and 17. Eyebolts 75 with jam nuts 93 are inserted through holes 89 in uprights 15, 17 and corresponding holes 91 in legs 21 and 23.

The braces 31 and 33 are attached to uprights 15, 17 by means of round head screws 43 with supplementary lockwashers 45 and nuts 47 passing through holes 97 in uprights 15, 17 and corresponding holes 99 in braces 31, 33. The lower crossbar 25 having legs 27, 29 telescoping into the extending ends of braces 31, 33 is secured by eyebolts 79 with jam nuts 105 passing through holes 101 in said braces and corresponding holes 103 in the legs 27, 29. Eyebolt 77 with jam nuts 107 is locked in position at the lower end of uprights 15, 17 and serves as the anchoring point for the S-hooks attached in the grommeted holes 71 in the side panels 53 and 55. Eyebolts 65 with jam nuts 66 pass through holes 102 in braces 31, 33 and serve as anchor points for the cord 59 when the conversion to a ball-returning practice net is made.

The assembled frame 11 is anchored in place at the appropriate position in the playing area or field by means of anchor stakes 37 and the U-shaped clevises 35. To complete the assembly, the net 13 is easily attached to the frame 11 by S-hooks and the self-contained straps 83 on the top edge 81. Thus in the utilization of the above described invention, two of the assembled goal nets 10 can be anchored on opposing ends of a playing field or a single unit can be converted to a ball-returning practice net for use in a restricted area, such as a residential backyard.

In summary, there has been described a soccer practice net and goal structure which in its unassembled state can be packaged in a compact container no longer than the longest tubular component of the unit, thereby facilitating attractive merchandising of said item and easy transportation and erection at the playing site.

However, the primary advantage of the above described invention is its inherent capability of being readily converted from a goal net to a ball-returning practice net which automatically returns the ball to the player.

What is claimed is:

1. A ball goal and practice net comprising:

a frame adapted to stand generally upright on the ground and defining an upright rectangular opening;

a net attached to said frame and disposed behind said opening to form a resilient back for receiving balls passing through said opening;

first means connected to said net for holding said net back in a first configuration inclined downward and backward from the top of said opening approximately to the ground to capture balls passing through said opening;

second means connected to said net for forming an angle in said net, the vertex of said angle extending horizontally across said net below the top of the frame and a substantial distance above the ground, for holding said net back in a second configuration inclined downward and backward from the top of said opening and thence, at the vertex of said angle, forward and downward about to the ground for returning balls passing through said opening.

2. A ball goal and practice net as defined in claim 1 and further comprising brace members extending from each vertical side of said frame down and back to the ground.

3. A ball goal and practice net as defined in claim 2 wherein said second means includes means on each vertical edge of said net intermediate its top and bottom and means on said brace members intermediate their ends for connection to each other to establish the vertex of said angle a substantial distance above the ground in said second configuration.

4. A ball goal and practice net as defined in claim 3 and further comprising a tension cord extending laterally across the back of said net along the vertex of said angle a substantial distance above the ground in said second configuration.

5. A ball goal and practice net as defined in claim 3 wherein said second means further comprises means near the lower end of each vertical edge of said net back and means near the bottom of each side of said frame for connection to each other in said second configuration.

6. A ball goal and practice net as defined in claim 5 wherein said first means comprises means near the bottom of each said brace for connection to said means near the lower end of each vertical edge of said net back in said first configuration.

7. A ball goal and practice net as defined in claim 6 wherein each of the connection means of said first and said second means are readily connected and unconnected without any tools.

8. A ball goal and practice net as defined in claim 1 wherein said frame is a tubular frame in a U-shape with upright side members and a horizontal top member.

9. A ball goal and practice net as defined in claim 8 wherein said frame side members are an identical pair of straight tubular members.

10. A ball goal and practice net as defined in claim 1 wherein said brace members are interconnected at their bottoms by a tubular frame member.

11. A ball goal and practice net as defined in claim 1 and further comprising side portions on said net attached to said frame and closing the sides between said frame and said net back.

* * * * *

UNITED STATES PATENT AND TRADEMARK OFFICE

CERTIFICATE OF CORRECTION

PATENT NO. : 4,083,561

DATED : April 11, 1978

INVENTOR(S) : Fred R. Daffer, Jr.

It is certified that error appears in the above-identified patent and that said Letters Patent are hereby corrected as shown below:

Page 1, Column 2, Line 38, after "51", "as" should be "was".

Signed and Sealed this

*Third* Day of *October 1978*

[SEAL]

*Attest:*

RUTH C. MASON
*Attesting Officer*

DONALD W. BANNER
*Commissioner of Patents and Trademarks*